US006518492B2

(12) United States Patent
Herberger et al.

(10) Patent No.: US 6,518,492 B2
(45) Date of Patent: Feb. 11, 2003

(54) SYSTEM AND METHOD OF BPM DETERMINATION

(75) Inventors: Tilman Herberger, Dresden (DE); Titus Tost, Dresden (DE); Georg Flemming, Dresden (DE)

(73) Assignee: Magix Entertainment Products, GmbH, Berlin (DE)

( * ) Notice: Subject to any disclaimer, the term of this patent is extended or adjusted under 35 U.S.C. 154(b) by 0 days.

(21) Appl. No.: 10/120,069

(22) Filed: Apr. 10, 2002

(65) Prior Publication Data

US 2002/0148347 A1 Oct. 17, 2002

Related U.S. Application Data

(60) Provisional application No. 60/283,694, filed on Apr. 13, 2001.

(51) Int. Cl.[7] ..... G10H 1/40

(52) U.S. Cl. ..... 84/636; 84/668; 84/484; 84/DIG. 12

(58) Field of Search ..... 84/612, 636, 652, 84/668, 714, 477 R, 484, DIG. 12

(56) References Cited

U.S. PATENT DOCUMENTS

| | | | | |
|---|---|---|---|---|
| 4,655,113 A | | 4/1987 | Bunger et al. | |
| 4,694,724 A | | 9/1987 | Kikumoto et al. | |
| 4,945,804 A | | 8/1990 | Farrand | |
| 5,220,120 A | | 6/1993 | Mukaino | |
| 5,227,574 A | * | 7/1993 | Mukaino | 84/652 |
| 5,256,832 A | | 10/1993 | Miyake | |
| 5,382,750 A | * | 1/1995 | Masahiko et al. | 84/636 |
| 5,521,324 A | * | 5/1996 | Dannenberg et al. | 84/612 |
| 5,585,585 A | | 12/1996 | Paulson et al. | |
| 5,614,687 A | | 3/1997 | Yamada et al. | |
| 6,175,632 B1 | * | 1/2001 | Marx | 84/477 R X |
| 6,380,474 B2 | * | 4/2002 | Taruguchi et al. | 84/612 |

FOREIGN PATENT DOCUMENTS

| | | |
|---|---|---|
| EP | 0477869 A2 | 4/1992 |
| JP | 401182897 A | 7/1989 |
| JP | 404151694 A | 5/1992 |
| JP | 404156594 A | 5/1992 |
| JP | 404156595 A | 5/1992 |
| JP | 406027957 A | 2/1994 |

* cited by examiner

*Primary Examiner*—Stanley J. Witkowski
(74) *Attorney, Agent, or Firm*—Fellers, Snider, Blankenship, Bailey & Tippens, P.C.

(57) ABSTRACT

There is provided an improved system and method of determining the tempo of a digitized musical work that, optionally, allows a user to participate in the BPM determination. A first preferred aspect includes determination of estimates of the BPM of a musical work by utilizing at least two different algorithms, thereby producing a plurality of separate BPM candidates. As a further preferred aspect, the method utilizes, as an optional step, input from the user to assist in selecting the "best" BPM from among the plurality of BPMs determined previously. Preferably, the user is given the option of "tapping along" with the music by pressing the mouse or a key on the computer in time to the music as it is played. The program analyzes the first few taps and, from that input, selects from the BPMs the one that is most consistent with the user's input.

20 Claims, 5 Drawing Sheets

SYSTEM AND METHOD OF BPM DETERMINATION

This application claims priority from provisional application No. 60/283,694 filed Apr. 13, 2001.

The present invention relates to the general subject matter of creating and analyzing digital recorded performances and, more specifically, to systems and methods for determining the tempo or beats-per-minute ("BPM") of a section of digital music.

BACKGROUND OF THE INVENTION

Determining the "beat" or tempo of a piece of music is an ability that comes naturally to most people. Taping a foot in time to a piece of music, clapping, dancing, etc., are all natural responses to the rhythmic content of a musical composition. The ability of a human to rapidly sense the general beat inherent within a piece of music does not usually require any training or study. Even those who have no musical training can be quite proficient at this seemingly simple task.

However, humans—and especially those that are untrained—cannot consistently locate the beat very accurately by tapping in time to the music. It is almost inevitable that the successive taps will be slightly off beat (either ahead or behind the beat) by at least as few milliseconds. While that small amount of inaccuracy makes little difference where the only object is to move in synchronization with the music (e.g., while dancing), even small inaccuracies in the exact beat spacing can cause problems when two musical works are merged together (e.g., by playing them simultaneously), as the occurrence of the beats in the musical works will become successively more out of sync over time if their BPMs have not been adjusted as to be virtually identical.

Thus, it would seem natural to use computers to automatically determine the tempo of a composition and, in fact, many have devised algorithms that do exactly that. However, the goal of obtaining a general purpose algorithm that is accurate for a wide variety of styles of music and instrument/vocal combinations has proven to be elusive for a number of reasons. First, it is the rare musical work that does not have some inherent imprecision in its tempo, wherein the beats occur slightly out of their proper time position. Additionally, it is common in musical works for "drift" to occur, i.e., for one portion of a single musical work to have slightly faster or slower tempo than another. Further, since the "beat" might be carried by a drum one moment and the bass the next, beat determination must generally be robust enough to accommodate these sorts of changing musical conditions. Thus, those that are skilled in the art will recognize that these, and many other, practical problems make automatic tempo determination a difficult problem for a computer generally, although most such algorithms may work acceptably in limited circumstances. For example, a musical work that includes a percussive instrument such as a drum would be a better candidate for automatic BPM determination than, say, a musical work that features vocalist that is singing a cappella.

Of course, the ability to identify the beat in a section of music is of more than of just academic interest. Knowledge of the BPM of a musical work is useful in many settings, but it is particularly useful when it is desired to combine musical elements that have been taken from different compositions. That is, if a user wishes to combine a digital drum recording (or "drum track") with a digital horn track to make an ensemble arrangement, it is necessary that the two tracks be at the same tempo or BPM. To the extent that they are at different BPM's , there are mathematical methods of adjusting one track to match the other that are well known to those skilled in the art. But, of course, those methods rely on a knowledge of the actual BPM of each track.

Additionally, in a "DJ" setting wherein a "disk jockey" is responsible for playing a series of popular songs for purposes of dancing and the like, it is usually desirable to play the songs in such a way that, as one song fades into the next, the "beats" of the two songs coincide. This means that the BPM's of the two songs must be made to nearly match, so that when the songs are be played together (i.e., during the fade-in/fade-out) the corresponding beats in the two songs occur at nearly the same time.

It has been common in the past to require the user to participate in the determination of the BPM of a digital recording by "tapping along" with the music as it plays, e.g., by pressing a mouse button, a key on the keyboard, or some other computer input device in time to the music. A computer program then reads the user's input and calculates an approximate BPM therefrom. Of course, some users are better at this operation than others and, since a user's tap will seldom be exactly on the beat, it may take a rather long time for the computer program to be able to estimate with any accuracy the BPM of the song.

Thus, what is needed is a method of BPM determination that functions automatically to determine the tempo of a digital song. Further, this determination should be flexible enough to be applied to both the analysis of prerecorded musical works and to real time analysis of a live performance. Optionally, the method should be able to benefit from a user's input to refine the BPM estimate.

Heretofore, as is well known in the music and video industries, there has been a need for an invention to address and solve the above-described problems. Accordingly, it should now be recognized, as was recognized by the present inventors, that there exists, and has existed for some time, a very real need for a device that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

There is provided hereinafter an improved system and method for determining the tempo of a digitized musical work which, optionally, allows a user to participate in the BPM determination. More specifically, the instant method utilizes a plurality of different BPM determinations, in concert with input from an end-user, if that is so desired, to arrive at a preferred BPM estimate for a particular digital musical work.

A first preferred aspect of the instant invention includes a method of determination of estimates of the BPM of a musical work which utilizes at two different algorithms, thereby producing a plurality of separate BPM "candidates". In the preferred embodiment, one or more of the BPM candidates will be determined via construction of an allocation density function, which is designed to categorize the observed inter-beat time intervals into groupings that correspond to half notes, quarter notes, eighth notes, etc., as well as other (usually "false") note intervals such as three or five eighth-notes, five sixteenth-notes, etc., which will fall "between" the halves, quarters, etc., in the allocation density function. Peaks in the allocation density function correspond to candidate BPMs for the musical work.

These candidates, optionally including additional BPM candidates obtained through the use of other algorithms, will then be evaluated to select the "best" (or "true") BPM for the particular musical work as is described below. In the preferred arrangement, an "auto-tap" analysis will be employed to select the true BPM from among the multiple candidates. The auto-tap procedure is an adaptive process that effectively "taps" along with the music at a tempo determined by the candidate BPM and notes instances where predicted beats do not correspond to actual beats in the musical work and/or where actual beats in the music do not correspond to the generated beats at the candidate BPM tempo. Additionally, the preferred algorithm adaptively and dynamically makes small adjustments to the candidate BPMs to make it fit as nearly as possible the observed beats in the music. Finally, in the preferred arrangement multiple BPMs will be auto-tapped simultaneously, thereby making it possible for the instant invention to operate in real-time.

As a further preferred aspect of the instant invention, input from a user is solicited for purposes of selecting the "best" BPM from among the plurality of BPM estimates determined to previously. That is, the user is given the option of "tapping along" with the music by pressing, for example, the mouse or a key on the computer in time to the music as it is played. The program analyzes the first few taps and, from that input, selects from the BPM estimates the one that is most consistent with the user's input. Note that this requires only a very few "user taps," in contrast to the number that would normally be required to get an accurate estimate of the BPM directly from the user. Another advantage of soliciting user input is that the user will typically choose to tap along with the "quarter note" beat, thereby resolving for the software the issue of whether a particular BPM candidate corresponds to a quarter note, eighth note, etc., beat frequency.

The foregoing has outlined in broad terms the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Additionally, the disclosure that follows is intended to apply to all alternatives, modifications and equivalents as may be included within the spirit and scope of the invention as defined by the appended claims. Further, it should be understood that the phraseology and terminology employed herein are for the purpose of description and should not be regarded as limiting, unless the specification specifically so limits the invention. Further objects, features, and advantages of the present invention will be apparent upon examining the accompanying drawings and upon reading the following description of the preferred embodiments.

DETAILED DESCRIPTION OF THE PREFERRED EMBODIMENTS

There is provided hereinafter an improved system and method of determining the tempo of a digitized musical work which, optionally and as a preferred final step, allows a user to participate in the process of BPM determination. More specifically, the instant method utilizes as plurality of different BPM determinations, in concert with input from an end-user if he or she so desires, to arrive at a best BPM for a particular digital musical work.

BACKGROUND OF THE INVENTION

Figure 3:
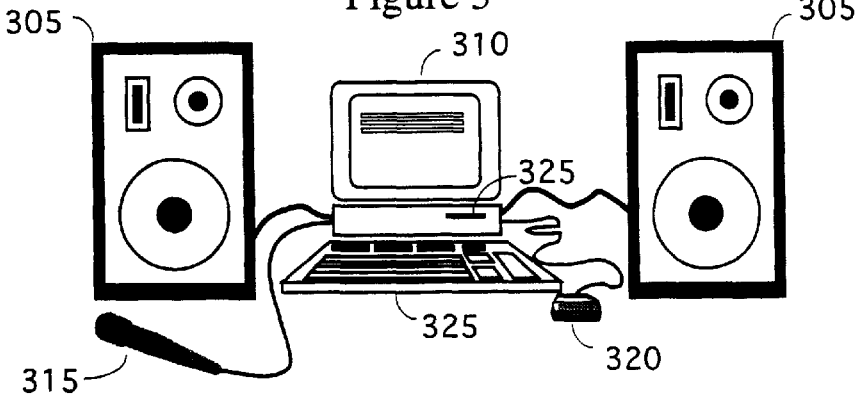
FIG. 3 illustrates the general environment of the instant invention.

As is generally illustrated in FIG. 3, in a preferred arrangement the instant invention will utilize a computer 310 that has the capability of reading some sort of storage media, e.g., a CD-ROM reader 330, or other storage device such as hard disk, RAM, or network access to a remote storage device. Further, and is conventional in the industry, the computer 310 will be equipped with an attached keyboard 325 and mouse 320, and with one or more external speakers 305 which can be used to reproduce the music that is played by the computer 310. Of course, headphones which plug into the audio output port of the computer are commonly used instead of the external speakers 305. External microphone 315, which is attached to the computer 310 might also be provided and which would be useful, for example, in recording and digitizing real-time performances. That being said, those of ordinary skill in the art will recognize that there are many variations and combinations of the equipment of FIG. 3 that could function according to the instant invention.

As an initial matter, it should be noted and remembered that the BPM estimation methods discussed hereinafter can operate either in "real-time" or on pre-recorded musical works, where "real-time" should be broadly construed to include any situation where the instant methods operate on digitized musical information, whether acquired during an actual performance or otherwise. Of course, those skilled in the art will recognize that that even a so-called real-time algorithm necessarily needs to collect at least a small section of recorded music before it can perform its analysis, which means that it will always lag slightly behind the performer (typically by at least a couple of seconds) in its determination of the current BPM. It should further be clear than an algorithm that is suitable for a real-time application, could also be applied to analyze prerecorded works. In summary, the instant invention can operates on music as it is recorded in a musical performance or thereafter by reading digital musical information that is stored in a computer readable medium such as a hard disk, a compact disk, a laser disk, a magneto-optical disk, a floppy disk, computer RAM, computer ROM, a compact flash card, an EPROM, etc.

Additionally, it should be further noted that there are actually two parameters that need to be determined in connection with BPM detection and playback. In addition to the rate or tempo of the beats, the "phase" (i.e., location of the starting beat) must also be established. Although it is usually desirable to know the location of the first actual beat of the song, those of ordinary skill in the art will recognize that, more generally, some beat of the song, and preferably a beat that corresponds to a quarter note, must be affirmatively located in time in order to synchronize two playing songs. Additionally, and preferably, the located beat will be the first such beat in a measure. Then, the beats that follow (or precede if necessary) can be located with respect to this reference beat by using a knowledge of the BPM. So, for purposes of the instant disclosure, it should be understood that the term "starting beat" is used in its broadest sense to include the affirmative location in time of any specific quarter beat in the song.

Broadly speaking, a BPM determination would normally be expected to operate on one of two sorts of musical data: either MIDI data files or directly on the digitized music. For purposes of the instant disclosure, it will be assumed that the term "digital music" refers to music that is captured in the form of prerecorded digitized information (such as is found on conventional audio CDs, MP3 files, etc.), or that is analyzed during live performances that are recorded and contemporaneously converted to digital form. The BPM determination might be either in "real time" (i.e., wherein the BPM is determined as the music or musician is playing) or otherwise (e.g., where the software can read and analyze a pre-recorded work).

PREFERRED EMBODIMENTS

Turning now to a detailed discussion of the preferred automatic method of BPM detection, broadly speaking the problem that is solved herein may be generally divided into three sub-problems. The first is the identification of individual "beats" in the music (i.e., determining the beat positions). The second sub-problem involves determining the characteristic time interval between successive beats (i.e., determining the BPM candidates of the musical work). Finally, the third such sub-problem is that of selecting from among the BPM candidates the value that best represents the actual tempo of the musical work. Each of these components will be separately discussed below.

Figure 2:
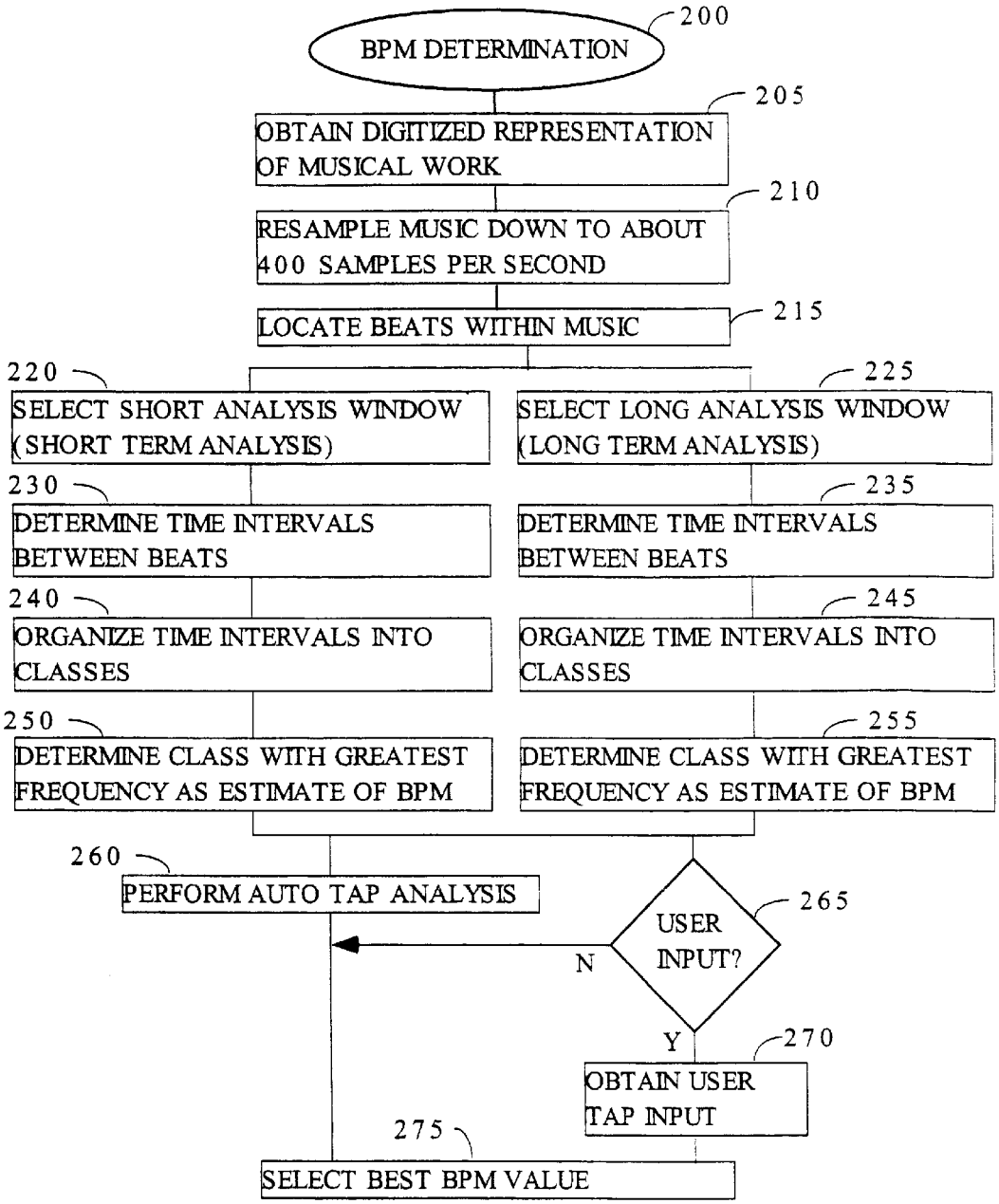
FIG. 2 illustrates how loops are preferably defined and extracted from the musical work.

As a first preferred step in the instant method 200 and as is generally set out in FIG. 2, the musical composition (or portion of said composition) that is to be analyzed is converted to digital form 205, the format of which might take any form that would be suitable for storing digital audio information including, for example, MP3 files, WAV files, conventional digital audio of the sort found on an audio CD, etc. In the event that the musical work that is to be analyzed has previously been recorded and stored on disk, the preferred method would begin by reading all or part of the musical work from the storage media into computer RAM where it can be examined by the computer algorithms discussed hereinafter. Alternatively, if the instant method is to be applied to real time (e.g., performance) data, the first step would be to digitize the audio signal(s) of the performance according to methods well known to those of ordinary skill in the art. In either case, however, the instant method is designed to work with digital audio information, in contrast to those methods that might analyze MIDI note and/or MIDI controller information as those well-known terms are used in the field of electronic music.

As a next step, the musical work is preferably down-sampled or resampled by a factor of about 100 (step 210). That is, the instant algorithm preferably utilizes a maximum of about every 100th digital sample in the musical work, this is assuming, of course, that the music has been sampled at 44,100 samples per second which is conventionally done. This resampling will result in an effective preferred sample rate of about 400 samples per second, which is adequate for the purposes disclosed herein. In the event that the music is digitized at a different sample rate (i.e., other than at 44 kHz), the exact amount of down-sampling would need to be determined by trial and error, but the preferred amount of down-sampling would be proportionally related to the alternative sample rate and selected so as to yield about 400 samples per second after down-sampling.

As a preferred next step, a series of beats are located 215 within the music, preferably by using about 20,000 or so of the re-sampled digital values (i.e., about 50 seconds of the musical work). The particular method used to identify the beats is not important for purposes of the instant invention, although the preferred method involves beat detection via envelope analysis, wherein beats are identified by detecting peaks in the envelope of the music. Note that there are any number of algorithms for detecting beats in a digital musical work and that the particular choice of the algorithm will be dependent on the type of music, the type of instruments, the recording parameters, and many other considerations.

That being said, according to a preferred aspect of the instant invention musical beats are preferably identified 215 by examining two aspects of the digital music. The first such aspect is the envelope of the music, wherein a sharply inclined phase is often indicative of the initial part of a beat—i.e., the attack. Secondly, the change in the overall amplitude of the music during the beat is additionally often a useful indicator which can be used to differentiate between a general increase in volume and a true beat. Preferably, both such aspects of the music will be used as part of the beat location step 215. That being said, the instant invention does not require the utilization of any particular method of beat identification, and there are many such methods that would be suitable for use herewith.

Next, the preferred embodiment proceeds to determine at least two different estimates of the BPM of the selected musical work (e.g., the short 220 and long 225 window analysis branches in FIG. 2). Although the instant inventors have specifically contemplated that conventional BPM determination methods might be employed to provide these values, in the preferred arrangement the BPM determination will be made using the method discussed below, wherein one of the estimates will be based on a short term/window analysis (branch 220) and the other on a longer term/window analysis (branch 225), the main difference between the two analysis branches being the amount of digital information from the musical work that is utilized in the computation.

In the preferred arrangement, the "short-term" analysis will preferably be performed on a window of at least about 2.5 seconds of music (i.e., about 100,000 digital samples before down-sampling) whereas the "long-term" analysis will preferably utilize about 30 seconds or so of digital information. Each of these analyses will yield separate estimates of the time-distribution of beat intervals and each is potentially useful. However, for some sorts of music, e.g., if the music has several bars that lack a well defined beat structure (e.g., during musical "breaks" or vocal solos), the long-term analysis will usually produce a superior estimate of the actual BPM.

Figure 1:
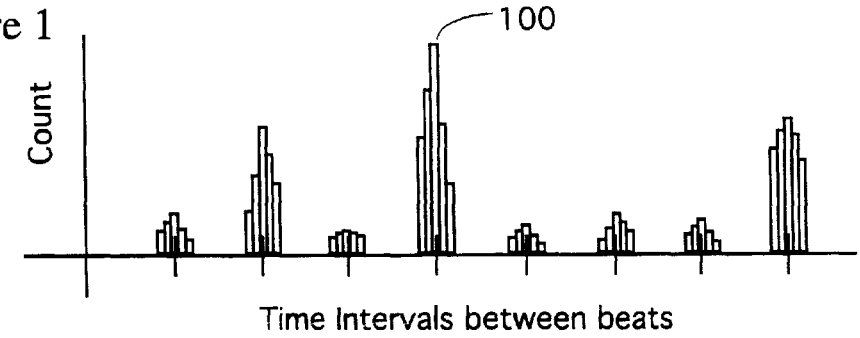
FIG. 1 contains a schematic illustration of a typical temporal distribution histogram.
Figure 4:
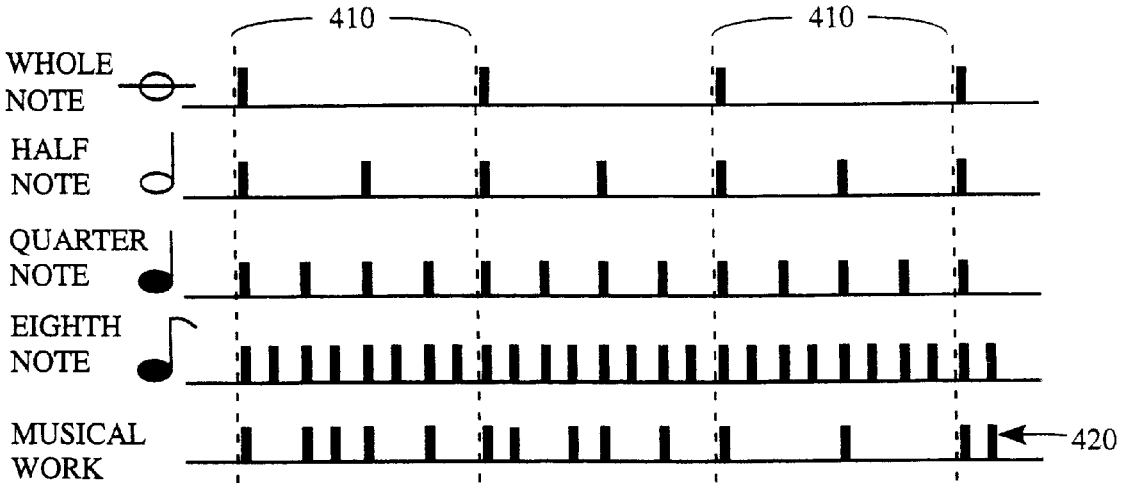
FIG. 4 contains a schematic illustration of how different BPM values can correspond to different note durations.

As a next preferred step, given a series of beats (step 215), the time differences between successive beats (i.e., inter-beat intervals) will be determined 230/235 for both the short and long analysis windows and then those time intervals will be categorized into different classes depending on their size (FIG. 1, generally). By way of explanation, in a typical musical work there will be a number of different kinds of beats, some of which occur on a quarter note, some on a half note, others on an eighth or sixteenth note, within a triplet, etc. FIG. 4 illustrates in a general way the nature of this problem. In BPM determination the preferred approach is to determine the temporal spacing between successive quarter notes in a four-beat measure, such temporal spacing being directly related, of course, to the BPM of the musical work. Of course, those skilled in the art will recognize that the task of finding the inter-quarter note spacing is complicated by the fact that very little music is exclusively comprised of notes of a single duration (e.g., the musical work 420 contains combinations of eight notes, quarter notes, and half notes, etc.). Note that, for purposes of illustration, measure dividers 410 have been introduced into FIG. 4 to make clearer the time-duration of each of the illustrated notes. The computer program that is given the task of determining the tempo of a song will not generally have any prior knowledge of the location of measure boundaries such as these. Further, the time signature might not be 4/4 but might instead be 6/8, 2/2, 9/4, etc., in which case the goal might be to identify the time-spacing between successive eighth notes, half notes, etc. That being said, for purposes of specificity in the text that follows, it will be assumed that the selected musical work is in 4/4 time and that it is desired to determine quarter note spacing.

As is illustrated in FIG. 4, in the musical work 420 a quarter note interval is followed by two eighth note intervals, which are then followed by two quarter note intervals, etc. It should be clear that there will a corresponding scattering of inter-beat time intervals, depending on the complexity of the musical work, the types of notes to which the successive beats correspond, and the regularity with which the actual performers follow the beat.

Figure 5:
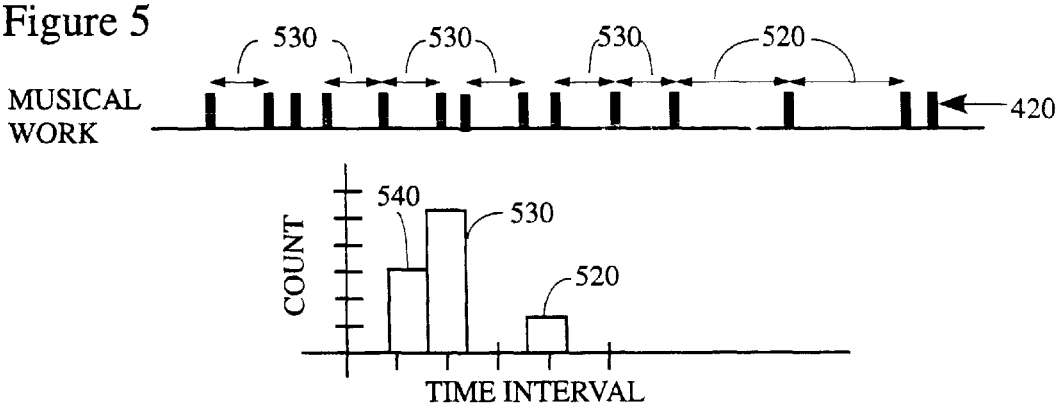
FIG. 5 illustrates a preferred method of constructing an allocation density function that would be suitable for use with the instant invention.

A preferred way of analyzing the collection of inter-beat times that has been determined at the previous step is via the formation of an "allocation density function". As is generally illustrated in FIG. 1, the allocation density function is, in simplest terms, a histogram of the magnitudes of the observed inter-beat times as determined from the subject musical segment. The peaks (Y-axis maxima) in the allocation density function correspond to the frequently occurring time-intervals in the musical work which should, at least in theory, relate to the most commonly occurring types of beats in that composition (whole note, half note, quarter note, etc.) FIG. 5 contains a specific example of the beat interval histogram of FIG. 1 which has been calculated from the music fragment 420. Note that in this simple example there are two occurrences of time interval 520; six occurrences of time interval 530; and, five occurrences of time interval 540. Obviously, complex musical works that have been analyzed over a longer period of time will yield many more observed time intervals. Although, the calculated time differences between successive beats might have some slight scatter for any number of reasons, by rounding, truncation, binning, etc., it should normally be possible to obtain a histogram expression of the portion of the musical work that clearly evidences a number of BPM candidates.

Although the time interval that corresponds to the quarter note beat may not be definitively identified at this point, it is possible to at least identify short and long time separations between beats and categorize them accordingly.

As is generally indicated in FIGS. 1 and 5, if a histogram is formed from the empirically determined time intervals, some inter-beat time intervals will be observed more frequently than others. These time intervals will correspond to peaks in the time-interval histogram of FIG. 1 (peak 100). Additionally, there will usually be a distribution (scatter) of times about a central "beat" time (which scatter has been somewhat exaggerated in the figures). Since the spacing between successive quarter notes will tend to be the most frequently observed time interval in western music, the time that corresponds to the most frequent inter-beat interval will often correspond to that beat. Thus, as a rough approximation, the time corresponding to peak 100 will be selected (at least initially) as the BPM for the measured musical work. However, this method, taken by itself, does not generally produce very accurate BPM estimates and is heavily dependent on the nature of the musical work.

Of course, any of the time intervals that is represented by a peak in FIG. 1 might eventually turn out to be the defining beat time interval for the BPM of the musical work, e.g., it might correspond to a "quarter note" time interval. At this stage, however, depending on the circumstances it may not be clear which of the many possible BPM candidates that were suggested by the previous analysis corresponds to the actual BPM of the musical work and it is anticipated that one or more BPM candidates will emerge based on the histogram distribution.

Optionally, the instant invention will utilize still other methods of BPM determination so as to obtain a plurality of BPM estimates for subsequent by the instant invention. Such methods are generally well known to those of ordinary skill in the art. What is important for purposes of the discussion that follows, though, is that a plurality of BPM estimates be made available for use at the next step, whatever the source of those estimates.

Figure 6:
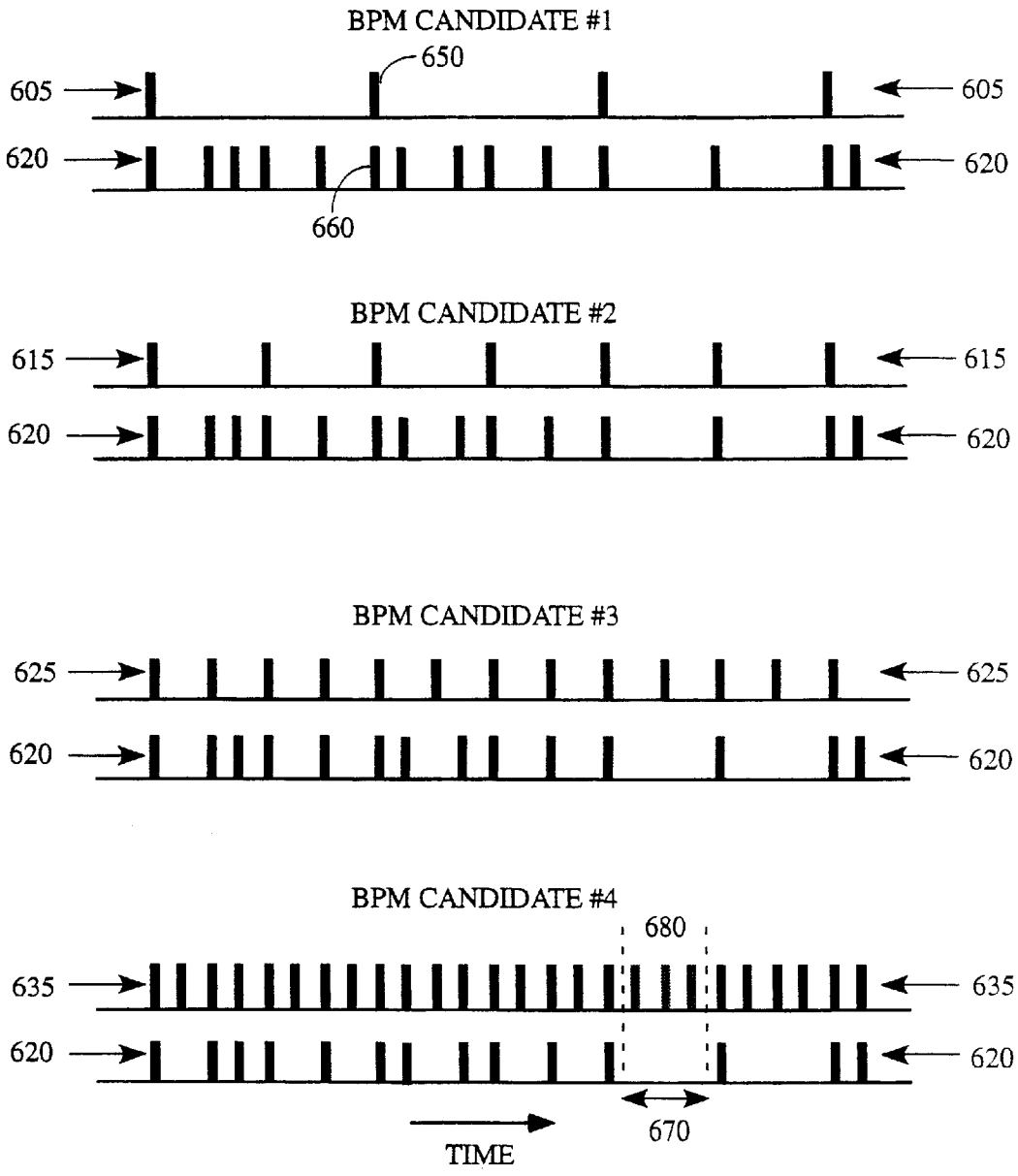
FIG. 6 contains a schematic illustration of how the preferred auto-tap embodiment functions.

As a next preferred step an "auto-tap" analysis 250/255 is performed on the musical work using the BPM candidates developed previously. As is generally illustrated in FIG. 6, given the plurality of estimates of the BPM from the previous step, and a first beat location, the digital music 620 is examined in order to select the best BPM for this musical work from among the candidates. In FIG. 6, there are four BPM candidates, each of which corresponds to a different tempo. In some cases, it may be that all of the BPM candidates will be integer multiples of each other and correspond to half, quarter, eighth, notes, etc., within the musical work. However, this sort of arrangement cannot be counted on to happen in general and the instant invention operates the same whether or not this relationship holds. Further, in the preferred arrangement (e.g., FIG. 9) multiple BPM estimates will be tested simultaneously, but that is not strictly required.

During the auto-tap phase, the program, in effect, "taps" along with the section of music using each of the BPM estimates provided and examines the previously determined beat locations within the music to determine whether or not a beat occurs at the time predicted by the current BPM estimate. By way of explanation, to the extent that quarter note beats arrive at times different than those predicted by the initial estimates, the BPM estimates are adjusted accordingly based on the difference between the predicted and observed beat occurrences. Additionally, those BPM estimates that are poor predictors of the beat locations will be down graded as candidates and, potentially, removed from further consideration depending on the desires of the programmer and/or user. For example, in one preferred embodiment a BPM estimate might be removed if it "misses" five or more beats in the music. Of course, the exact number of "missed" beats necessary to trigger removal could depend on a host of other parameter settings, the determination of which would be well within the capability of one of ordinary skill in the art.

In FIG. 6, the beats 605, 615, 625, and 635 that are predicted by the various BPM Candidates are represented as vertical bars that are positioned at equally spaced intervals in time, which intervals are defined by the numerical value of various candidate values, whereas the true beats in the example musical work are represented by vertical bars 620 which occur at a variety of different beat spacings as might be observed in an actual musical work. Note that, in this simple example, BPM Candidate #1 places each of its beats 605 at a position in time that corresponds to one of the actual beats 620 in the target song (e.g., single beat 650 as predicted by BPM Candidate #1 corresponds exactly to single beat 660 in the musical work). That observation is certainly consistent with the hypothesis that Candidate #1 is the proper BPM for this musical work. However, note how many of the intermediate beats in the target song 620 are not matched by this candidate. This fact argues against BPM Candidate #1 as being the best choice.

At the opposite extreme, note that all of the beats 620 of the musical work have a corresponding beat among the BMP Candidate #4 predicted beats 635. However, many of the predicted beats 635 that were generated at this tempo have no corresponding beat 620 in the musical work (e.g., time interval 670 is a "blackout" wherein there are several predicted beats 680 which have no corresponding beats 620 in the song ). The appearance of blackouts argues against this being the true BPM of the musical work.

Thus, the "best" BPM candidate will likely be one of the middle choices: it will be one which matches "most" of the beats 620 in the musical work without erroneously predicting too many extraneous beats that have no corresponding beat 610 in the actual music. Formulating a numerical measure of "fit" or "accuracy" that reflects a balance between these two competing criteria might be done in many ways, but the exact weight given to each criteria may ultimately be a matter of trial and error and could possibly differ depending on the musical style, instrumental composition, etc., of the musical work under analysis. That being said, it is well within those of ordinary skill in the art to devise a method of balancing these two considerations, empirically if necessary, to identify a best BPM candidate.

Figure 7:
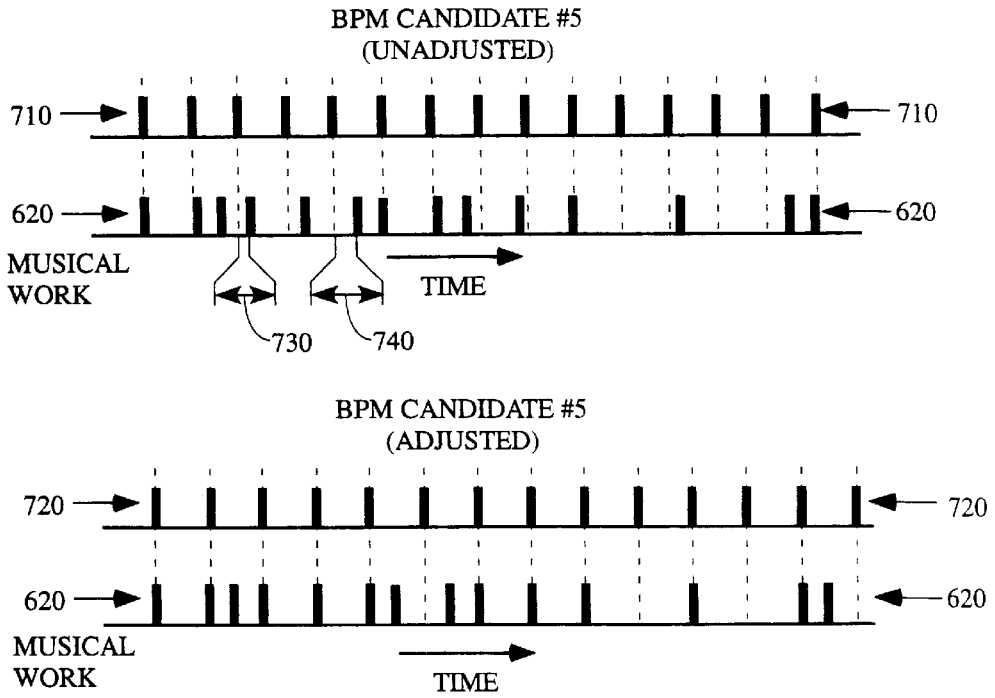
FIG. 7 illustrates a situation wherein it might be necessary to adjust the Candidate BPM as part of the auto-tap process.

The previous step includes an analysis and comparison of each of the candidate BPMs with respect to the selected musical work. In the process of doing this it may become apparent that better BPM estimates could be obtained if the values of the current candidates were adjusted slightly. Thus, the instant inventors have contemplated that each of the BPM estimates may be further refined during the previous "auto-tap" analysis step. FIG. 7 illustrates why this might be necessary and desirable. Note in FIG. 7 that the beats 710 of BPM Candidate #5 are slightly inaccurate as measured against the original song beats 620 (i.e., the beat spacing for Candidate #5 is a bit too small). As a consequence, the longer that the candidate is tapped 710 against the original song 620, the more inaccurate its beats become. For example, time difference 740 is larger than time difference 730. Actually if it is allowed to run long enough, the candidate beats 710 will eventually "synchronize" again with the original musical work, after which the differences will steadily increase again, etc.

Obviously, if the instant auto-tap algorithm detects that a BPM value is slightly inaccurate, it would easily be possible to correct it and (auto)tap the corrected BPM against the musical work again (corrected beats 720 in FIG. 7). That is, in the preferred embodiment part of the auto-tap analysis will include a determination of the extent to which the time-position of the predicted beats systematically vary or differ from those found in the music. As is generally illustrated in FIG. 7, it is possible, for example, to calculate timing differences 730 and 740 between the candidate beats 710 and the beats in the music 620. In a preferred arrangement, the instant method proceeds linearly through the music, dynamically correcting the current BPM candidate according to the calculated differences.

Although this dynamic correction might be done in many different ways, the instant inventors prefer the following general approach. An initial beat location is determined within the musical work 620 and beats corresponding to the current BPM estimate are "tapped" against it as described previously. For each predicted beat generated by the current BPM estimate, e a time difference may be calculated between it and the nearest actual musical beat. If the calculated time differences 730/740 differ by, say, more than 10% from the beat interval as obtained from the estimated BPM, the instant method will preferably adjust the current BPM estimate by calculating a "new" beat location (and associated BPM) corresponding to the midpoint between the actual beat in the music and the predicted auto-tapped beat. The method will then preferably continue by auto-tapping the adjusted BPM against the music until (1) the difference again exceeds the chosen percentage and another correction is applied; (2) until the BPM is determined to be so inaccurate that it is discarded as a candidate; or, (3) until the BPM estimate is of the required accuracy. Note that this sort of adaptive process is especially useful when there are subtle tempo changes in the music, as the instant algorithm will tend to be able to "learn" the new tempo by adjusting the current BPM upward or downward as described above.

Figure 9:
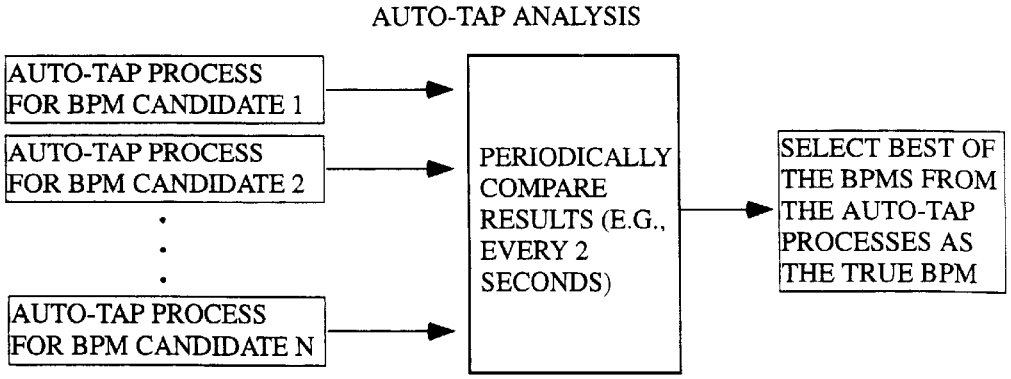
FIG. 9 illustrates generally a preferred embodiment of the "auto-tap" aspect of the instant invention.

The instant inventors prefer that each auto-tap process be "started" at some point in the music and allowed to work its way sequentially therethrough. Additionally and preferably, multiple BPMs are tested concurrently via the auto-tap process, i.e., multiple auto-tap processes are run at the same time on the same musical work, thereby making it possible to analyze music in real time. As is generally illustrated in FIG. 9, each BPM candidate spawns a separate process that determines the degree to which that tempo matches the musical work and adjusts the starting BPM estimate if appropriate. Further, it is anticipated that if a BPM candidate proves to be a bad fit to the actual beat sequence in the music, the algorithm will terminate that auto-tap process and that BPM estimate will be eliminated it from further consideration.

If the user does not elect to participate in the next optional step, the best (i.e., most accurate) of the plurality of BPM estimates tested previously will become the BPM estimate for this work. In fact, the instant inventors' experience is that the previous steps yield quite accurate BPM estimates for many types of music, and this is especially true for modern dance music, wherein the rhythm tracks (e.g., drum/percussion tracks) might be created by drum machines, sequencers, or other computer generated sources which can execute with mathematical precision. Music that is rhythmically complex, that has sophisticated rhythm structures, or that lacks a drum/percussion track are most likely to benefit from the user verification step that follows.

In a preferred arrangement, the BPM candidates will be differentiated based on multiple criteria, including such information as a count of the missing beat positions in the music (e.g., predicted beats with no corresponding beat in the music) and the difference between the predicted beat positions and the actual beat positions in the music. With respect to the second measure, preferably the statistical variance will be calculated using the numerical values of the differences obtained for each BPM estimate. That is, in each case where a predicted beat is proximate to an actual beat in the music, a time difference will be calculated as has been discussed previously. If all such differences are accumulated over some length of the musical work, the statistical variance (or standard deviation, or other measure of numerical spread such a median absolute deviation, etc.) can be calculated from those numerical values according to methods well known to those of ordinary skill in the art. Additionally, it is preferred that the variance of the "difference between the differences" be calculated. That is, the instant inventors prefer that the successive pairs of difference values be subtracted, thereby yielding a second sequence of numerical values. The statistical variance of these numbers provides insight into how the beat in the musical work is changing and the degree to which the subject BPM estimate has tracked it. More specifically, if the music has tended to speed up during the section analyzed, the calculated variance of the difference between the differences will be lower. This is in contrast to the situation where there is "jitter" (i.e., some predicted beats are ahead of the corresponding beat in the music and others are behind) in the music. In this second case, the calculated variance will be larger, indicating that the corresponding BPM estimate is not tracking true quarter notes. Of course, many other diagnostic numerical and statistical measures might be calculated from the difference sequences, any of which might potentially prove to be useful in the determination of which BPM candidate best fits the observed music.

Finally, all of the information collected and/or calculated at the previous step can be used to determine which of the candidate BPMs is the best choice for the analyzed musical work. In most instances, there will be a "consensus" of the measures: the BPM estimate with the lowest statistical variance will also be the one with the fewest missed beats, the fewest "extra" beats, etc. However, ultimately the weighting of the various measures calculated above will need to be determined on a trial and error basis, with the particular weighting often depending heavily on the type of music.

Turning now to another preferred embodiment of the instant invention, there is provided a method of automatic BPM determination substantially as described above, but including the further step of allowing the user to provide additional input to the BPM selection process by doing what end-users typically do best: tapping along with the music 265. In this aspect of the instant invention, the user will be given the option 265 of "tapping along" with the music by pressing a mouse, computer key, electronic keyboard key, or other switch/input device, as the music plays through attached speakers 310 or headphones, the user's taps thereby at least approximately defining the beat for the musical work.

Figure 8:
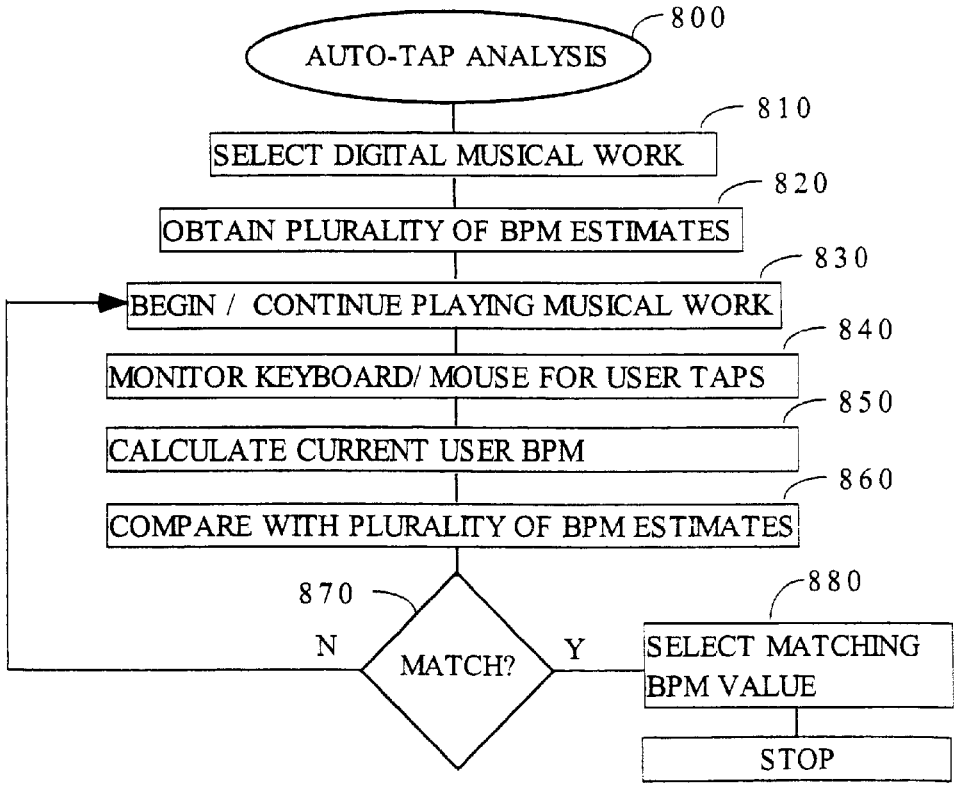
FIG. 8 contains a schematic illustration of a preferred embodiment of the "auto-tap" aspect of the instant invention.

As is generally illustrated in FIG. 8, in a preferred variation a musical work will have been digitized 810 and analyzed 820 in advance to prepare a plurality of BPM estimates for use in the current method. A computer program will initiate the playing 830 of a portion of the digital musical work and monitor 840 the selected input device (e.g., mouse or keyboard) for evidence of a user's taps, each such tap corresponding to a time since the song began to play and/or a time interval since the previous tap. As the music is played, in the preferred embodiment the computer program 800 will continuously calculate 860 an estimate of the BPM of the music based on the time separation between the user's taps according to methods well known to those of ordinary skill in the art. Of course, the user-based estimation process will preferably continue for so long as the user desires, until the end of the music is reached, and/or until the monitoring program has a sufficiently accurate estimate of the BPM from the user. At some point depending on its programming, the monitoring software will compare 860 the current tap-based BPM estimate with the plurality of previously-calculated BPM estimates. In one preferred arrangement, a determination will be made as to whether or not the user-BPM is close to or matches one of the pre-calculated BPMs. That is, it is well recognized that the time spacing between any two consecutive user-taps may be a somewhat inaccurate measure of the actual BPM, whereas a longer series of taps will tend to yield a more accurate overall (e.g., average) measure of BPM. Further, the BPM estimate based on the user's taps will likely change with time as more information is made available to the monitoring program. As a consequence, in one preferred arrangement the monitoring program will periodically (and/or continuously) compare 860 the current tap-based BPM estimate with the pre-calculated measurements and, when the user's BPM is "close" 870 to one of the pre-calculated ones, select the matching BPM value 880 and terminate the user's participation. In other variations, the user will be continuously informed as to the current BPM estimate (via tapping) and which pre-calculated BPM it most nearly matches, etc. Obviously, one of ordinary skill in the art can devise many alternative ways to get such information from the user and to compare it with the pre-existing BPM values.

Note that the previous method makes it possible to determine with high accuracy the BPM of the music after only a very short period of tapping by the user. In a typical case, it may require only a few seconds of user tapping before a BPM can be selected. Of course, this situation stands in marked contrast to the prior art which has historically required a very large number of user-taps (i.e., very long period of tapping) in order to obtain an accurate BPM estimate. Additionally, input from the user will help resolve the question of whether a particular BPM candidate corresponds to "quarter notes" or to "eighth notes" or some other note frequency. That is, and has been described previously, it may very well be that the BPM candidates corresponding to eighth notes and to quarter notes may both fit the observed music fairly accurately and can prove to be hard to select between them algorithmically. However, since the user will tend to tap along at a quarter note pace, the user's input will provide the program with additional information to make what may be a difficult BPM selection choice.

Additionally it should be noted that the user's input can be used to make the on-beat/off beat decision as those terms are known to those of ordinary skill in the art. By way of explanation, the true BPM value of a musical work corresponds with the series of true quarter notes (i.e., "on-beat") or the eighth notes between them (i.e., "off-beat"). The user will tend to select the on-beat (quarter note) tempo when he or she taps along with the music. In many cases this additional information is not particularly important for establishing the tempo of the music (i.e., an accurate BPM based on every other eighth note can, in some circumstances, be just as useful as the value based on quarter notes for the same work). However, the on-beat/off-beat decision can be important for synchronization between two songs that are to be merged and for other sorts of applications and the user is ideally suited for helping make this decision.

Finally, the instant inventors contemplate that it might further be desirable to optionally refine the best BPM from the previous step by comparing it again with the musical work. That is, given the nearest BPM candidate as compared with the user's tap, that BPM might again be compared with the musical work (e.g., via an auto-tap analysis) to refine it further as has been discussed previously.

CONCLUSIONS

It should be noted and remembered that, since the instant invention is designed to work with digitized music, when "time" is mentioned herein, that term should be broadly understood to also include other methods of locating a particular section within a music work including a "sample number" (e.g., a count of the number of digital samples from the beginning of the musical work), SMPTE time codes, etc.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A method of BPM determination, wherein is provided a digital musical work, comprising the steps of:

(a) selecting at least a portion of said digital musical work;

(b) using at least said selected portion of said digital musical work to determine a plurality of BPM estimates associated with digital musical work;

(c) for at least two of said plurality of BPM estimates, performing an auto-tap analysis using each of said at least two BPM estimates; and, (d) selecting a final BPM estimate from among said at least two BPM estimates based on said auto-tap analysis.

2. The method of BPM determination according to claim 1, comprising the further steps of:

(e) storing a value representative of said selected final BPM estimate on computer readable media.

3. The method of BPM determination according to claim 1, comprising the further steps of:

(e) displaying said final BPM estimate to a user.

4. The method of BPM determination according to claim 3, wherein the step of displaying said final BPM estimate to a user comprises the step of printing said final BPM estimate.

5. The method according to claim 2, wherein the computer readable media of step (e) is chosen from the group consisting of computer RAM, computer ROM, a PROM chip, flash RAM, a ROM card, a RAM card, a floppy disk, a magnetic disk, a magnetic tape, a magneto-optical disk, an optical disk, a CD-R disk, a CD-RW disk, a DVD-R disk, or a DVD-RW disk.

6. The method according to claim 2, comprising the further steps of:

(f) reading from said computer readable media said value representative of said selected final BPM estimate; and, (g) using at least said final BPM estimate to change the tempo of said digital musical work to a different BPM.

7. A device adapted for use by a digital computer wherein a plurality of computer instructions defining the method of claim 1 are encoded, said device being readable by said digital computer, said computer instructions programming said digital computer to perform said method, and, said device being selected from the group consisting of computer RAM, computer ROM, a PROM chip, flash RAM, a ROM card, a RAM card, a floppy disk, a magnetic disk, a magnetic tape, a magneto-optical disk, an optical disk, a CD-ROM disk, or a DVD disk.

8. The method of BPM determination according to claim 1, wherein is provided a second musical work, further comprising the steps of:

(e) playing at least a portion of said second musical work at a tempo at least approximately equal to said selected final BPM estimate.

9. The method according to claim 1, wherein step (c) comprises the steps of:

(c1) selecting at least a portion of said digital musical work, (c2) determining a location of a plurality of beats within said digital musical work, (c3) selecting a BPM candidate from among said plurality of BPM candidates, (c4) generating at least two predicted beat locations using said selected BPM candidate, (c5) selecting a generated beat and a corresponding beat in said musical work, (c6) calculating a time difference between said selected generated beat and said corresponding beat in said musical work, (c7) if said time difference is greater than a predetermined threshold value, determining an adjusted BPM value based on said selected BPM value, wherein a predicted beat from said adjusted BPM value will lie between said selected generated beat and said corresponding beat in said musical work, (c8) performing steps (c5) through (c7) at least twice, and, (c9) performing steps (c3) through (c8) at least twice.

10. The method of BPM determination according to claim 1, wherein step (c) comprises the steps of:

(c1) selecting a BPM estimate from among said plurality of BPM estimates, (c2) determining a start time within said digital musical work corresponding to said selected BPM estimate, (c3) creating a series of generated beat locations using said selected BPM estimate and said start time, (c4) determining a corresponding series of actual beat locations within said digital musical work, (c5) calculating at least one difference between one of said generated beat locations and one of said actual beat locations, and, (c6) performing steps (c1) through (c5) at least twice, thereby determining at least two differences for at least two different BPM estimates, and, wherein step (d) comprises the steps of:

(d1) using any differences determined in step (c6) to select a BPM for the musical work from among said at least two BPM estimates.

11. The method of BPM determination according to claim 1, wherein at least one of said plurality of BPM estimates of step (b) is determined according to the following steps:

(b1) selecting at least a portion of said digital musical work, (b2) automatically determining at least three beat locations within said digital musical work, (b3) calculating at least two inter-beat time intervals from said at least three beat locations within said digital musical work, (b4) forming an allocation density function from any inter-beat time intervals calculated in step (b3), (b5) using said allocation density function to determine at least one of said plurality of BPM estimates of step (b).

12. A method of BPM determination, wherein is provided a digital musical work, comprising the steps of:

(a) selecting at least a portion of said digital musical work;

(b) using said selected portion of said digital musical work to determine a plurality of BPM estimates;

(c) playing at least a portion of said digital musical work while simultaneously reading at least two user's taps made in concert with said played digital musical work;

(d) calculating a user-based BPM estimate (and correct the onbeat offbeat decision) for said musical work based on said at least two user's taps;

(d) performing steps (c) and (d) until said user-based BPM estimate is at least approximately equal to one of said plurality of BPM estimates; and, (e) selecting as a final BPM estimate said one of said plurality of BPM estimates that is at least approximately equal to said user-based BPM estimate.

13. The method of BPM determination according to claim 12, wherein is provided a second musical work, further comprising the steps of:

(f) playing at least a portion of said second musical work at a tempo at least approximately corresponding to said selected final BPM estimate.

14. The method of BPM determination according to claim 12, comprising the further steps of:

(e) displaying said final BPM estimate to the user.

15. The method of BPM determination according to claim 12, wherein at least one of said plurality of BPM estimates of step (b) is determined according to the following steps:

(b1) selecting at least a portion of said digital musical work, (b2) automatically determining at least three beat locations within said digital musical work, (b3) calculating at least two inter-beat time intervals from said at least three beat locations within said digital musical work, (b4) forming an allocation density function from any inter-beat time intervals calculated in step (b3), (b5) using said allocation density function to determine at least one of said plurality of BPM estimates of step (b).

16. A method of BPM determination, wherein is provided a digital musical work, comprising the steps of:

(a) selecting at least a portion of said digital musical work;

(b) determining a location of a plurality of beats within said digital musical work;

(c) forming an allocation density function using said located plurality of beats within said musical work;

(d) determining a plurality of BPM candidates using at least said allocation density function;

(e) selecting a BPM candidate from among said plurality of BPM candidates;

(f) generating at least two predicted beat locations using said selected BPM candidate;

(g) selecting a generated beat and a corresponding beat in said musical work;

(h) calculating a time difference between said selected generated beat and said corresponding beat in said musical work;

(i) if said time difference is greater than a predetermined threshold value, determining an adjusted BPM value based on said selected BPM value, wherein a predicted beat from said adjusted BPM value will lie between said selected generated beat and said corresponding beat in said musical work;

(k) performing steps (g) through (i) at least twice;

(l) performing steps (e) through (k) at least twice; and, (m) selecting from among said BPM candidates and any adjusted BPM values a best BPM estimate.

17. The method according to claim 16, wherein steps (e) through (k) are performed simultaneously for at least two different BPM candidates.

18. The method of BPM determination according to claim 16, wherein is provided a second musical work, further comprising the steps of:

(n) playing at least a portion of said second musical work at a tempo at least approximately corresponding to said selected best BPM estimate.

19. The method of BPM determination according to claim 16, comprising the further steps of:

(n) storing a value representative of said selected best BPM estimate on computer readable media.

20. The method according to claim 19, comprising the further steps of:

(o) reading from said computer readable media said value representative of said selected best BPM estimate; and, (g) using at least said selected best BPM estimate to change the tempo of said digital musical work to a different BPM; and, (h) playing at least a portion of said digital musical work at said different BPM.

* * * * *